US007287956B2

(12) United States Patent
Bracken et al.

(10) Patent No.: US 7,287,956 B2
(45) Date of Patent: Oct. 30, 2007

(54) REMOVABLE ABRADABLE SEAL CARRIERS FOR SEALING BETWEEN ROTARY AND STATIONARY TURBINE COMPONENTS

(75) Inventors: Robert James Bracken, Niskayuna, NY (US); Sterling Ray Hathaway, Schenectady, NY (US); David Orus Fitts, Ballston Spa, NY (US); Ron W. Korzun, Clifton Park, NY (US); Laurence Scott Duclos, Unity, ME (US); William Edward Adis, Schenectady, NY (US); Mark William Kowalczyk, Amsterdam, NY (US); Bernard Arthur Couture, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 6 days.

(21) Appl. No.: 11/017,661

(22) Filed: Dec. 22, 2004

(65) Prior Publication Data

US 2006/0133928 A1 Jun. 22, 2006

(51) Int. Cl.
*F01D 11/12* (2006.01)

(52) U.S. Cl. ..... 415/173.3; 415/173.4; 415/173.5; 415/173.6; 415/174.2; 415/174.4; 415/174.5; 415/230; 415/231

(58) Field of Classification Search ..... 415/173.3, 415/173.4, 173.5, 173.6, 174.2, 174.4, 174.5, 415/230–231; 277/412, 414–416
See application file for complete search history.

(56) References Cited

U.S. PATENT DOCUMENTS

| | | | | |
|---|---|---|---|---|
| 2,044,692 | A * | 6/1936 | Huhn | 277/415 |
| 2,600,991 | A * | 6/1952 | Hargrove | 277/416 |
| 3,501,246 | A * | 3/1970 | Hickey | 415/174.2 |
| 3,867,060 | A * | 2/1975 | Huber | 415/173.5 |
| 4,094,673 | A * | 6/1978 | Erickson et al. | 415/174.4 |
| 5,462,403 | A * | 10/1995 | Pannone | 415/173.4 |
| 5,501,573 | A * | 3/1996 | Sanders | 415/173.5 |
| 5,599,026 | A * | 2/1997 | Sanders et al. | 277/415 |
| 6,129,513 | A * | 10/2000 | Halliwell et al. | 415/173.4 |
| 6,358,002 | B1 * | 3/2002 | Good et al. | 415/174.4 |
| 6,547,522 | B2 | 4/2003 | Turnquist et al. | |
| 6,722,846 | B2 * | 4/2004 | Burdgick | 415/173.5 |
| 6,896,482 | B2 * | 5/2005 | Parry | 415/173.5 |
| 7,052,017 | B2 * | 5/2006 | Uchida et al. | 415/174.5 |
| 2004/0253100 | A1 * | 12/2004 | Blatchford et al. | 415/208.1 |

FOREIGN PATENT DOCUMENTS

| | | | | |
|---|---|---|---|---|
| EP | 382333 | A1 * | 8/1990 | 415/174.5 |
| WO | WO-02/077500 | A1 * | 10/2002 | |

* cited by examiner

*Primary Examiner*—Christopher Verdier
(74) *Attorney, Agent, or Firm*—Nixon & Vanderhye, PC

(57) ABSTRACT

The turbine includes a diaphragm having a seal carrier mounted in opposition to seal teeth carried by the rotary component. The seal carrier includes a seal face having a coating of abradable material enabling the rotary component to abrade the material from the seal face. The seal carrier is removable from the diaphragm and is carried by an axial extension integral with or removable from the outer diaphragm ring. A spring may be interposed between the seal carrier and the stationary component.

16 Claims, 3 Drawing Sheets

REMOVABLE ABRADABLE SEAL CARRIERS FOR SEALING BETWEEN ROTARY AND STATIONARY TURBINE COMPONENTS

BACKGROUND OF THE INVENTION

The present invention relates to seals between rotatable and stationary components of a turbine and particularly relates to removable seal carriers having abradable seal surfaces for sealing between rotatable and stationary turbine components.

In turbines, particularly steam turbines, seals between rotary and stationary components are a critical part of the steam turbine performance. It will be appreciated that the greater the number and magnitude of steam leakage paths, the greater the losses of efficiency of the steam turbine. For example, labyrinth seal teeth often used to seal between the diaphragms and the rotor or between the rotor bucket tips and the stationary shroud require substantial clearances to be maintained to allow for radial and circumferential movement during transient operations such as startup and shutdown. These clearances are, of course, detrimental to sealing. There are also clearance issues associated with multiple independent seal surfaces, tolerance stack up of radial clearances and assembly of multiple seals, all of which can diminish turbine efficiency. Moreover, it is often difficult to create seals which not only increase the efficiency of the steam turbine but also increase the ability to service and repair various parts of the turbine as well as to create known repeatable boundary conditions for such parts. Accordingly, there is a need for a seal which will eliminate or minimize clearance issues, enable assembly of multiple seals, minimize tolerance stack up of radial clearances, improve serviceability and enable stage by stage adjustment of diaphragms and adjacent seal surfaces effecting improved clearance control.

BRIEF DESCRIPTION OF THE INVENTION

In a preferred embodiment of the invention, there is provided a turbine having a stationary component and a rotary component, the stationary component including an annular array of stator vanes about the turbine axis and a diaphragm having a groove, the diaphragm including a seal carrier removably carried by the diaphragm in the groove and having a sealing face in opposition to a seal carried by the rotary component, the seal face being formed of an abradable material enabling the rotary component to abrade material from the seal face when sealing between the rotary and stationary components.

In another embodiment of the invention, there is provided a turbine comprising a stationary component and a rotary component, the stationary component including a diaphragm having an annular array of stator vanes about the turbine axis, the diaphragm including a seal carrier removably carried by the diaphragm, the seal carrier having a seal face in opposition to seal teeth carried by the rotary component, the seal face being formed of an abradable material enabling the rotary component to abrade material from the seal face when sealing between the rotary and stationary components, the diaphragm including a second seal face carried by the seal carrier along a generally axially facing surface thereof and in opposition to a seal surface carried by the diaphragm, the seal carrier being movable generally axially relative to the diaphragm to form a seal between the seal surface and the second seal face, one of the second seal face and the seal surface carrying an abradable material enabling another of the second seal face and the seal surface to abrade the material when sealing between the seal carrier and the diaphragm.

DETAILED DESCRIPTION OF THE INVENTION

Figure 1:
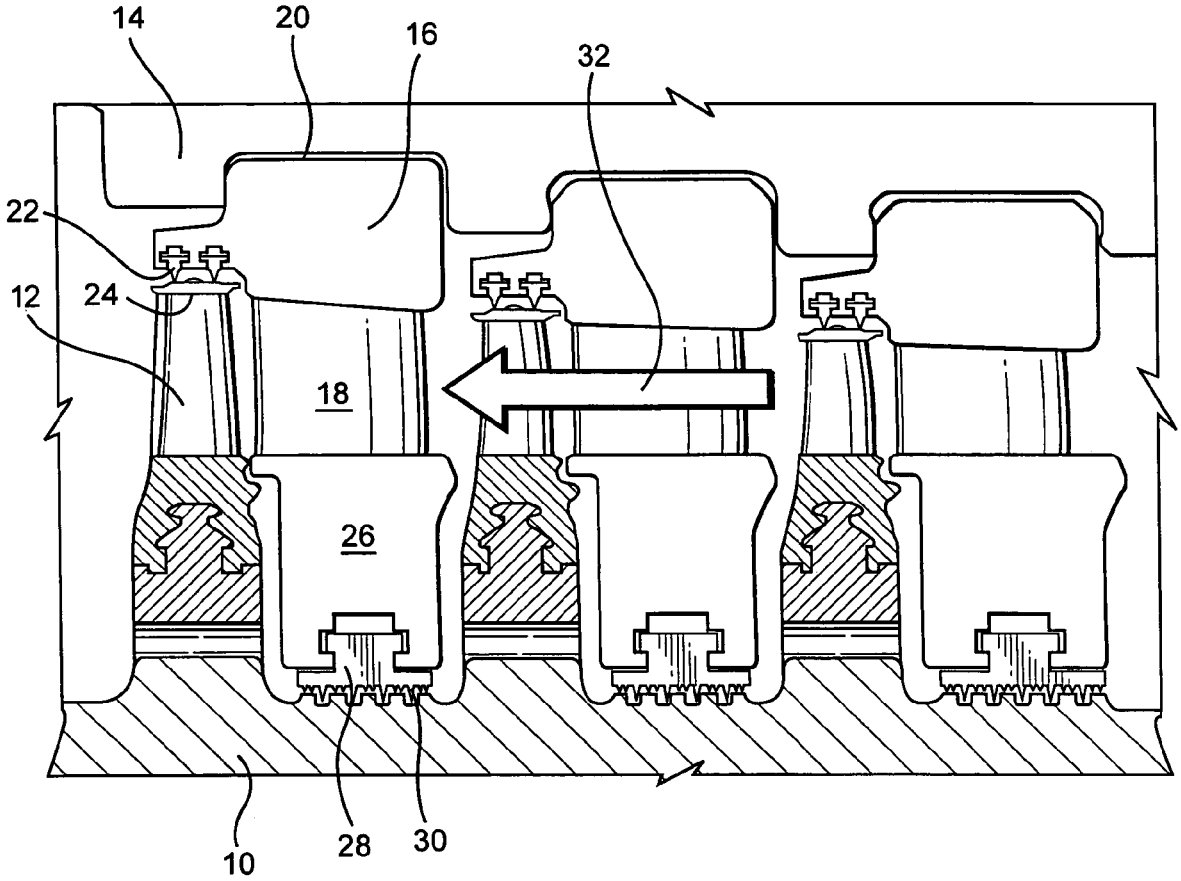
Fig. 1 (Prior Art)
FIG. 1 is a fragmentary cross-sectional view of a portion of a steam turbine illustrating various seals according to the prior art.

Referring now to the drawing figures, particularly to FIG. 1, there is illustrated a portion of a steam turbine having a rotary component, for example a rotor 10 mounting a plurality of circumferentially spaced buckets 12 at spaced axial positions along the turbine forming parts of the various turbine stages and a stationary component 14 including a plurality of diaphragms 16 mounting partitions 18 defining nozzles which, together with respective buckets, form the various stages of the turbine. As illustrated, the outer ring 20 of the diaphragm 16 carries one or more rows of seal teeth 22 for sealing with the shrouds or covers 24 adjacent the tips of buckets 12. Similarly, the inner ring 26 of diaphragm 16 mounts an arcuate seal segment 28. The seal segment has radially inwardly projecting high-low teeth 30 for sealing with the rotary component 10. Similar seals are provided at the various stages as illustrated and the direction of steam flow is indicated by the arrow 32.

Figure 2:
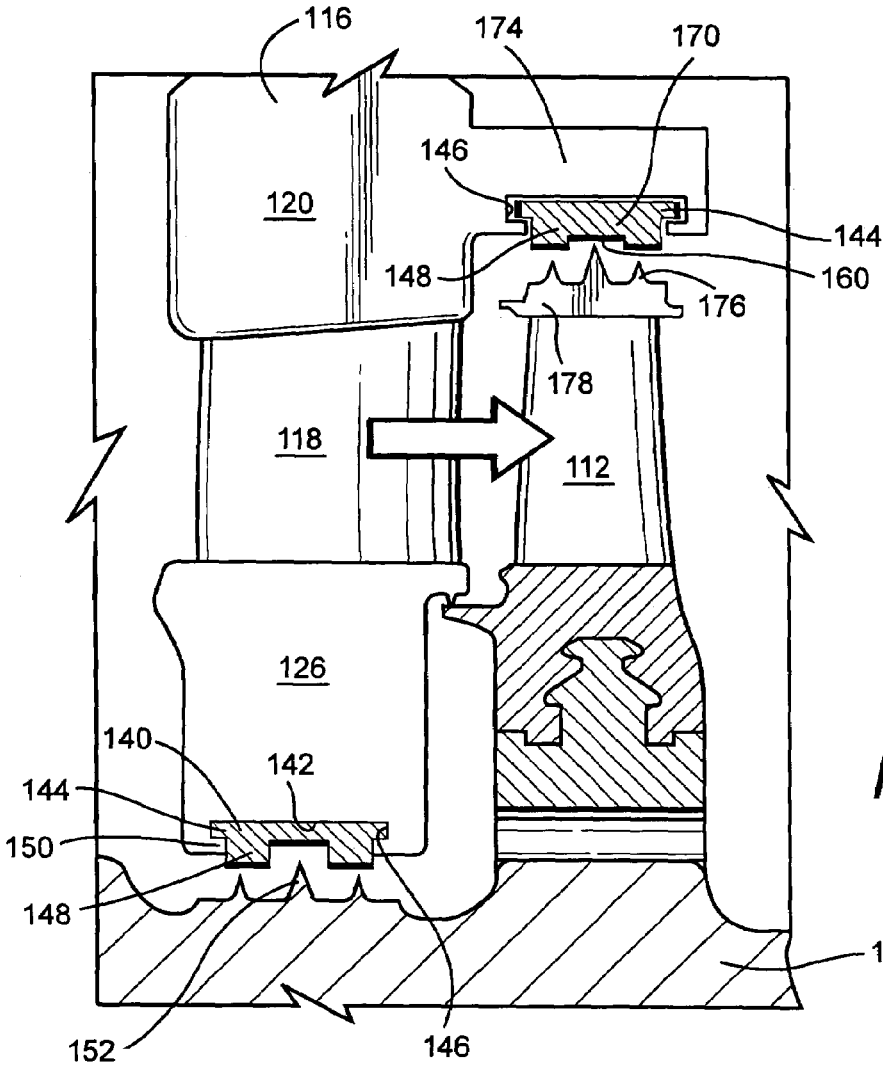
FIG. 2 is a fragmentary enlarged cross-sectional view of a steam turbine incorporating removable abradable seal carriers in accordance with an aspect of the present invention.
Figure 5:
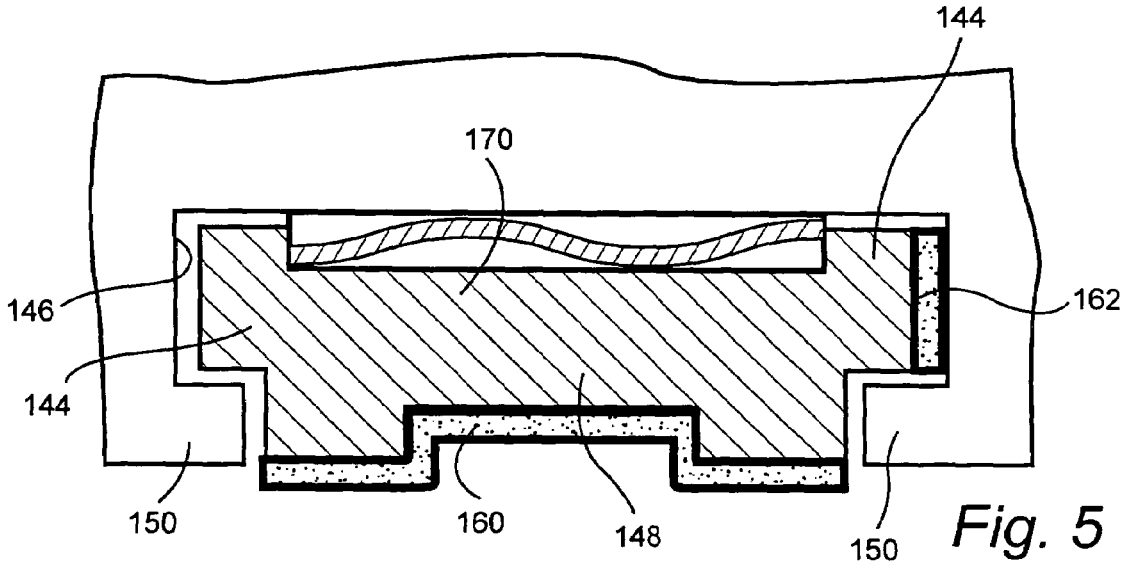
FIG. 5 is an enlarged fragmentary cross-sectional view of a representative seal carrier according to an aspect of the present invention.

Referring now to FIG. 2, like reference numerals are applied to like parts as in FIG. 1 preceded by the numeral 1. In FIG. 2, a seal carrier 140 has a dovetail configuration for reception in a generally complementary shaped dovetail groove 142 along the inner diameter of the inner diaphragm ring 126. Thus referring to FIGS. 2 and 5, the seal carrier 140 includes a pair of oppositely extending flanges 144 for reception in correspondingly axially spaced grooves 146 of the inner diaphragm ring 126. The seal carrier 140 has a neck portion 148 which projects between the inner diaphragm flanges 150 radially inwardly toward the rotary component, e.g. rotor 110. As illustrated the rotary component includes a plurality of seal teeth 152. As best illustrated in FIG. 5, the radially inwardly directed sealing surfaces of the seal carrier 140 are coated with an abradable material 160. The abradable material 160 may be of the type described and illustrated in U.S. Pat. No. 6,547,522 of common assignee herewith, the disclosure of which is incorporated herein by reference. Thus the abradable material may comprise a composition having a first component including cobalt, nickel, chromium and yttrium and a second component selected from the group consisting of hexagonal boron nitride and a polymer. Any one of the additional abradable materials disclosed in U.S. Pat. No. 6,547,522 can be similarly utilized in the present invention.

As illustrated in FIGS. 2 and 5, the abradable material 160 is provided on the radially inwardly facing surfaces of the seal carrier 140 in opposition to the teeth 152 of the rotor 110. A high-low-high configuration of the sealing surface of seal carrier 140 is illustrated with corresponding low-high-low teeth on the rotor 110. Additionally, it will be appreciated that because the seal carrier is located between differential pressure regions on axially opposite sides of the diaphragm, the seal carrier will be displaced in a downstream axial direction. To preclude steam leakage between the seal carrier 140 and the inner diaphragm ring 126, the abradable material 160 is also applied to the downstream face 162 of the flange 144 of the seal carrier to seal against the corresponding registering downstream surface of the dovetail 142 of the inner diaphragm ring 126. It will be appreciated that the abradable material may also be applied to the registering downstream surface of dovetail 142 rather than face 162. Consequently, the clearance between the seal carrier 140 and the seal teeth 152 may be reduced and any steam leakage path around the seal carrier 140 is eliminated or minimized.

Also illustrated in FIG. 2 is a similar seal carrier 170 mounted on an axial downstream flange or extension 174 of the outer diaphragm ring 120. The seal carrier 170 has a radially inwardly high-low-high sealing surface configuration with the abradable material 160 applied to those radially inwardly directed sealing surfaces. Teeth 176 carried on the tip cover or shroud 178 lie in radial opposition to the abradable material 160 of the sealing surfaces of carrier 170. In both aspects of the seal carriers, the clearance between the seal teeth and abradable material can be adjusted to accommodate transient conditions. Also, the potential leakage path between the seal carrier and its support structure, i.e. the inner or outer diaphragm rings 126 and 120, respectively, is sealed by the axially facing sealing surfaces on the downstream side of the carrier.

Figure 3:
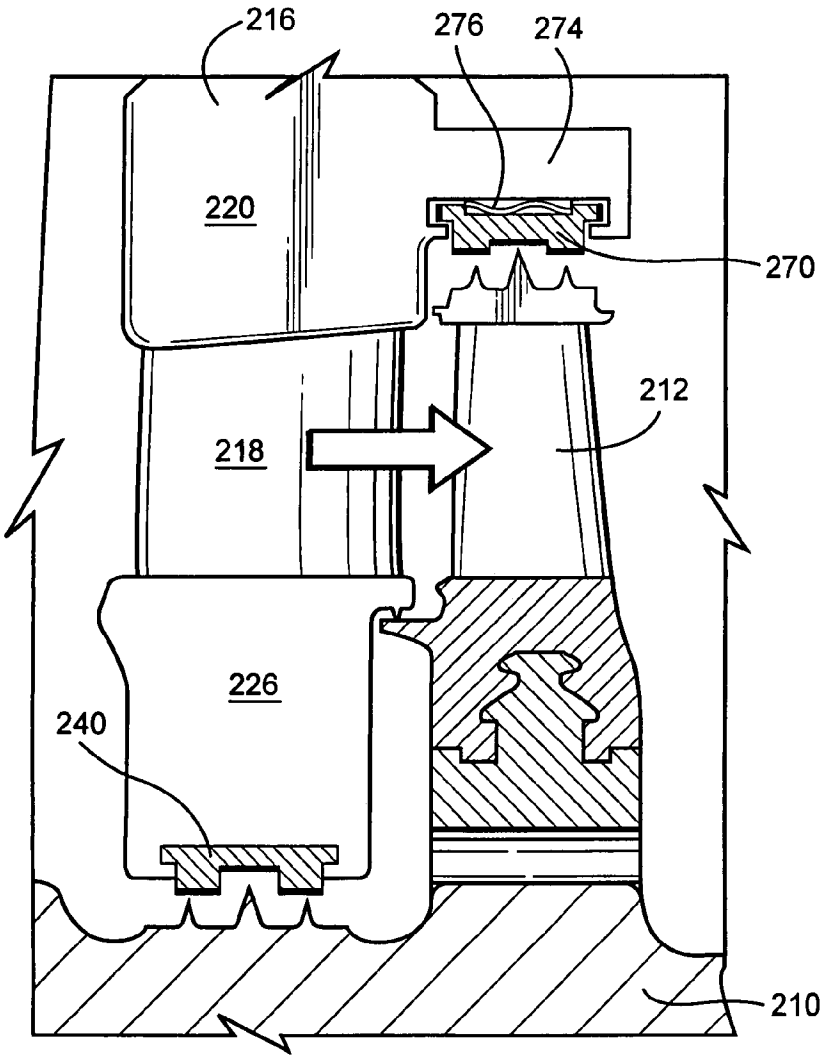

Referring now to FIG. 3, wherein like reference numerals apply to like parts as in FIG. 2, preceded by the numeral "2", one or both of the seal carriers 240 and 270 is spring biased in a radial direction to force fit the seal carrier against the axially extending flanges of the respective diaphragm support ring. The spring 276 may be an arcuate ripple spring. Abradable material is provided in a high-low-high configuration opposite low-high-low seal teeth similarly as previously described. Additionally, abradable material is applied on the downstream axial fit as well as on a corresponding circumferential axial fit within the seal surface to prevent bypass of steam about the abradable seal carrier. The steam pressure would force the coated seal carrier against the steam face. It will be appreciated that suitable hardware, not shown, is provided at the horizontal midline joint of the steam turbine to maintain the seal carriers against rotation.

Figure 4:
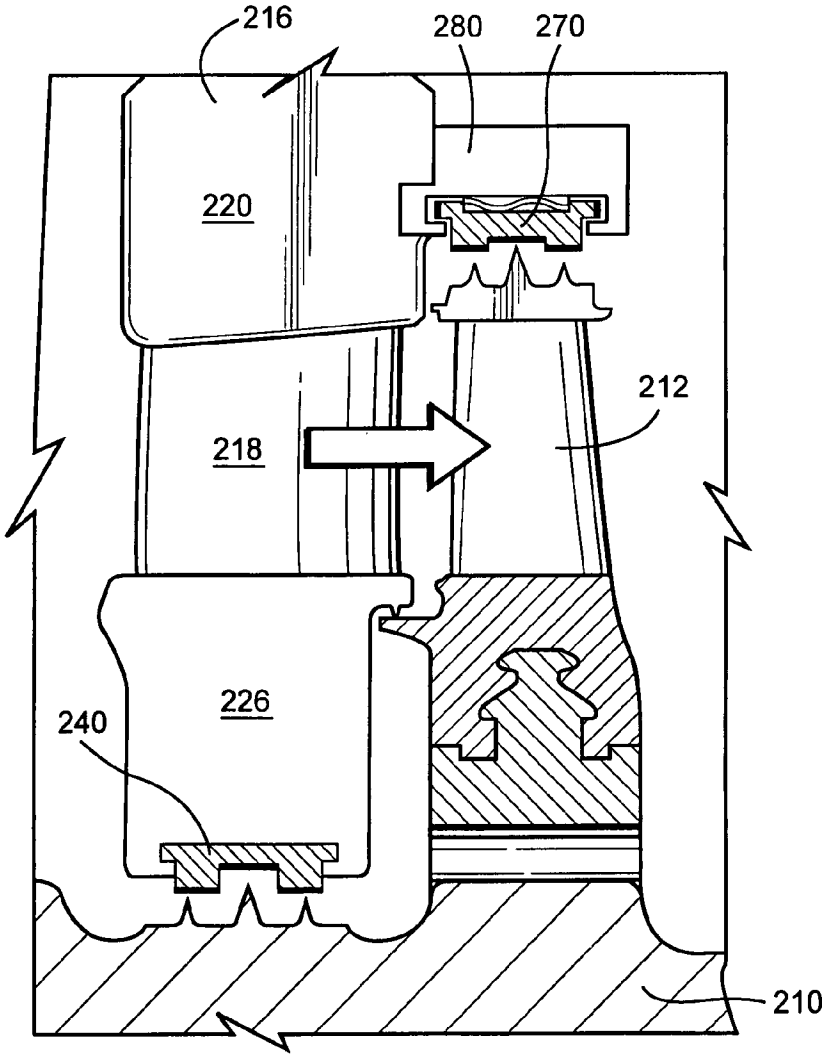
FIGS. 3 and 4 are illustrations similar to FIG. 2 showing the abradable seal carrier hereof in two different aspects thereof, respectively.

In FIG. 3, the seal carrier 270 is mounted on the flange or extension 274 which is integral with the outer diaphragm ring 220. Also illustrated is the flat arcuate ripple spring 276. In FIG. 4, the seal carrier 270 is mounted on a separate flange 280 which may be mounted to the outer diaphragm ring 220 in a number of different ways including welded, bolted, brazed, dovetailed or any other known methods of connecting various parts in a steam turbine to one another. It will be appreciated that the seal carriers in all aspects of the present invention comprise arcuate segments which can be inserted in a generally circumferential direction into the dovetailed grooves. Once the carrier seals have been inserted and mounted to the diaphragm, the final seal configurations can be machined together thus decreasing the radial clearance tolerance stack up.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a stationary component and a rotary component, said stationary component including a diaphragm having an annular array of stator vanes about the turbine axis, said diaphragm having a groove, including a seal carrier removably and slidably received in a circumferential direction in said groove, said seal carrier having a first seal face in opposition to seal teeth carried by said rotary component, said first seal face being formed of an abradable material layer applied over said seal carrier enabling said rotary component to abrade material from said first seal face when sealing between said rotary and stationary components, and a second seal face carried by said seal carrier along a generally axially facing surface of said seal carrier and in opposition to a seal surface carried by said diaphragm, said seal carrier being movable generally axially to form a seal between said seal surface and said second seal face, wherein said second seal face carries an abradable material enabling said seal surface to abrade said material when sealing between said seal carrier and said diaphragm.

2. A turbine according to claim 1 including a spring between said diaphragm and said seal carrier for biasing the seal carrier in a radial direction.

3. A turbine according to claim 1 wherein said first seal face on said seal carrier includes radially displaced surfaces and said seal teeth carried by said rotary component lie radially opposed to said abradable material layer.

4. A turbine according to claim 1 wherein said seal carrier is carried by said diaphragm at a location radially inwardly of said vanes.

5. A turbine according to claim 1 wherein said seal carrier is carried by said diaphragm at a location radially outwardly of said vanes.

6. A turbine according to claim 1 wherein said diaphragm includes an outer ring having an axial extension carrying said seal carrier at a location axially displaced from said vanes.

7. A turbine according to claim 6 wherein said extension is removably carried by said diaphragm outer ring.

8. A turbine according to claim 1 wherein said abradable material layer comprises a first component including cobalt, nickel, chromium and yttrium and a second component selected from the group consisting of hexagonal boron nitride and a polymer.

9. A turbine comprising:

a stationary component and a rotary component, said stationary component including a diaphragm having an annular array of stator vanes about the turbine axis, said diaphragm including a seal carrier removably carried by said diaphragm, said seal carrier having a first seal face in opposition to seal teeth carried by said rotary component, said first seal face being formed of an abradable material enabling said rotary component to abrade material from said first seal face when sealing between said rotary and stationary components, said diaphragm including a second seal face carried by said seal carrier along a generally axially facing surface of said seal carrier and in opposition to a seal surface carried by said diaphragm, said seal carrier being movable generally axially relative to said diaphragm to form a seal between said seal surface and said second seal face, one of said second seal face and said seal surface carrying an abradable material enabling another of said second seal face and said seal surface to abrade said material when sealing between said seal carrier and said diaphragm.

10. A turbine according to claim 9 including a spring between said diaphragm and said seal carrier for biasing the seal carrier in a radial direction.

11. A turbine according to claim 9 wherein said first seal face on said seal carrier includes radially displaced surfaces and said seal teeth carried by said rotary component lie radially opposed to said abradable material.

12. A turbine according to claim 9 wherein said seal carrier is carried by said diaphragm at a location radially inwardly of said vanes.

13. A turbine according to claim 9 wherein said seal carrier is carried by said diaphragm at a location radially outwardly of said vanes.

14. A turbine according to claim 9 wherein said diaphragm includes an outer ring having an axial extension carrying said seal carrier at a location axially displaced from said vanes.

15. A turbine according to claim 14 wherein said extension is removably carried by said diaphragm outer ring.

16. A turbine according to claim 9 wherein said abradable material of said first seal face and said abradable material carried on said one of said second seal face and said seal surface comprises a first component including cobalt, nickel, chromium and yttrium and a second component selected from the group consisting of hexagonal boron nitride and a polymer.

* * * * *